US010543613B2

(12) United States Patent
Boos et al.

(10) Patent No.: US 10,543,613 B2
(45) Date of Patent: Jan. 28, 2020

(54) CUTTING MACHINE FOR FOOD

(71) Applicant: Bizerba SE & Co. KG, Balingen (DE)

(72) Inventors: Paul Boos, Bodelshausen (DE); Christoph Klaiber, Gomaringen (DE); Markus Mueller, Balingen (DE)

(73) Assignee: BIZERBA SE & CO. KG, Balingen (DE)

( * ) Notice: Subject to any disclaimer, the term of this patent is extended or adjusted under 35 U.S.C. 154(b) by 0 days.

(21) Appl. No.: 16/218,509

(22) Filed: Dec. 13, 2018

(65) Prior Publication Data

US 2019/0184592 A1 Jun. 20, 2019

(30) Foreign Application Priority Data

Dec. 18, 2017 (EP) ..... 17208174

(51) Int. Cl.
*B26D 7/06* (2006.01)
*B26D 7/26* (2006.01)

(52) U.S. Cl.
CPC ..... *B26D 7/0616* (2013.01); *B26D 7/2642* (2013.01); *B26D 2210/02* (2013.01)

(58) Field of Classification Search
CPC . B26D 7/0616; B26D 2210/02; B26D 7/2642
See application file for complete search history.

(56) References Cited

U.S. PATENT DOCUMENTS 3,704,736 A 12/1972 Pratley
4,817,480 A * 4/1989 Young ..... B26D 7/12 451/419
5,245,898 A * 9/1993 Somal ..... B26D 7/00 248/653
6,167,791 B1 * 1/2001 Heckman ..... B26D 7/0616 83/717
6,209,438 B1 * 4/2001 Mitchell ..... B26D 7/0616 83/707
7,832,317 B2 * 11/2010 Zeeb ..... B26D 7/01 83/247
8,215,219 B2 * 7/2012 Rummel ..... B26D 5/26 83/13
2019/0061195 A1 * 2/2019 Klaiber ..... B26D 3/162

FOREIGN PATENT DOCUMENTS

DE 202008006020 U1 8/2008
GB 408176 A 4/1934

* cited by examiner

*Primary Examiner* — Sean M Michalski
(74) *Attorney, Agent, or Firm* — Leydig, Voit & Mayer, Ltd.

(57) ABSTRACT

A cutting machine for cutting slices of in particular strand-shaped cutting material includes: a machine housing; a drive motor; a cutting blade, driven in rotation by the drive motor in a cutting plane, for cutting off slices; a stop plate, displaceable parallel to the cutting plane, for setting a desired slice thickness; a carriage, movable back and forth parallel to the cutting plane, having a supporting plate and a bearing wall, the supporting plate and the bearing wall forming a holding device for the cutting material, the carriage including a pivoting device for moving the supporting plate between a starting position and a pivoted-up position, the supporting plate in the starting position and in the pivoted-up position forming a right angle with the cutting plane; and a fixing plate arranged orthogonal to the supporting plate and being rigidly connected to the supporting plate, the fixing plate including a slotted link.

20 Claims, 8 Drawing Sheets

CUTTING MACHINE FOR FOOD

CROSS-REFERENCE TO PRIOR APPLICATION

Priority is claimed to European Patent Application No. EP 17 208 174.7, filed on Dec. 18, 2017, the entire disclosure of which is hereby incorporated by reference herein.

FIELD

The present invention relates to a cutting machine for cutting food, having a carriage with a pivotable supporting plate.

BACKGROUND

Cutting machines for cutting slices off strand-shaped cutting material are known from the prior art.

DE 20 2008 006 020 U1 shows a cutting machine for food, the cutting material support of which can be pivoted or tilted with the aid of an adjusting mechanism.

SUMMARY

In an embodiment, the present invention provides a cutting machine for cutting slices of in particular strand-shaped cutting material, comprising: a machine housing; a drive motor; a cutting blade, driven in rotation by the drive motor in a cutting plane, configured to cut off slices; a stop plate, displaceable parallel to the cutting plane, configured to set a desired slice thickness; a carriage, movable back and forth parallel to the cutting plane, having a supporting plate and a bearing wall, the supporting plate and the bearing wall forming a holding device for the cutting material, the carriage comprising a pivoting device configured to move the supporting plate between a starting position and a pivoted-up position, the supporting plate in the starting position and in the pivoted-up position forming a right angle with the cutting plane; and a fixing plate arranged orthogonal to the supporting plate and being rigidly connected to the supporting plate, the fixing plate comprising a slotted link, the slotted link comprising at least two slots for a fixing element.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
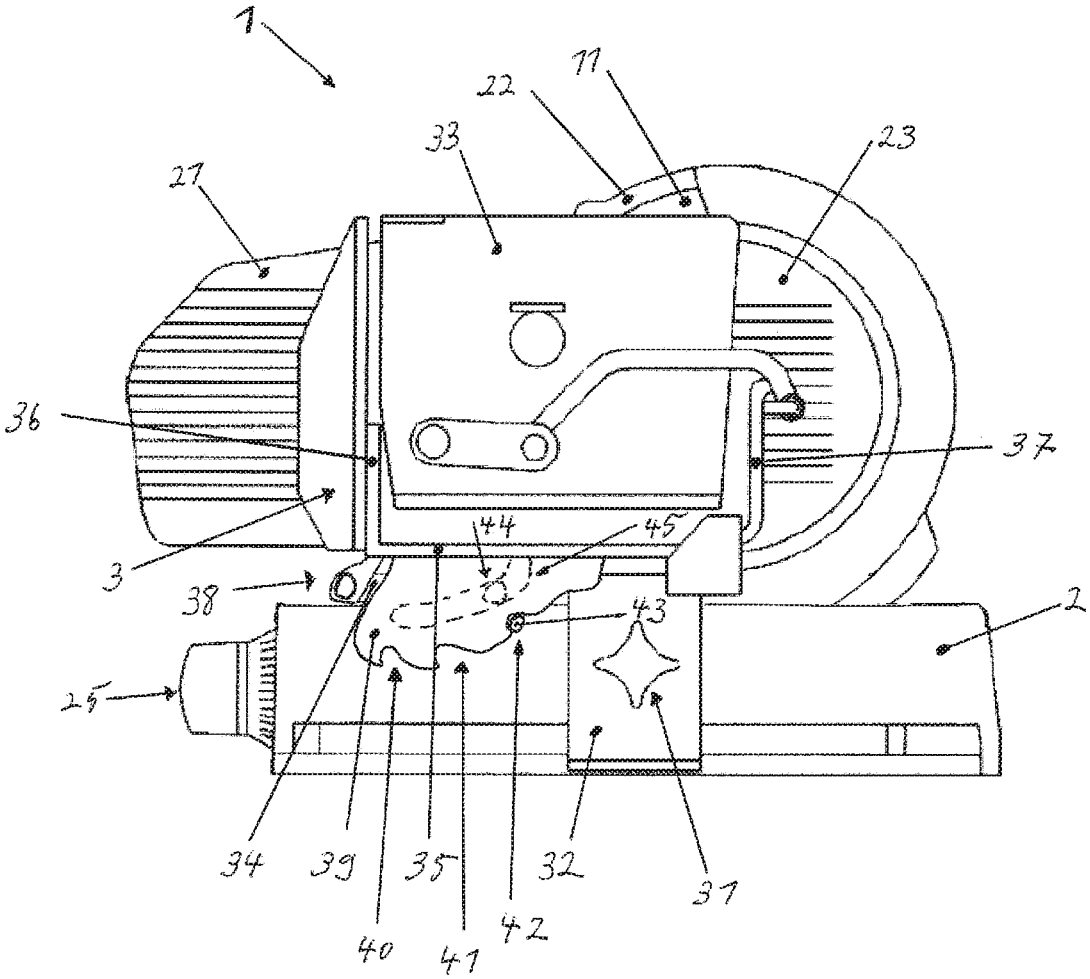
FIG. 1 shows a cutting machine according to the invention, designed as a vertical cutting machine.

The object of the invention is to improve a cutting machine of the aforementioned type and in particular to enable better fixing of the carriage.

The invention proposes a cutting machine for cutting slices of in particular strand-shaped cutting material. The cutting machine comprises a machine housing. The cutting machine comprises a drive motor and a cutting blade, driven in rotation by the latter in a cutting plane, for cutting of slices. A stop plate is movable parallel to the cutting plane and serves to set a desired slice thickness. The cutting machine comprises a carriage movable back and forth parallel to the cutting plane. The carriage comprises a supporting plate and a bearing wall. The supporting plate and the bearing wall form a holding device for the cutting material. In one embodiment, the supporting plate and the bearing wall are arranged orthogonal to one another. The carriage comprises a pivoting device, by means of which the supporting plate can be moved between a starting position and a pivoted-up position. In one embodiment, the supporting plate rests on the carriage base in the starting position. In the starting position and in the pivoted-up position, as well as in the pivot range in between, the supporting plate forms a right angle with the cutting plane. The cutting machine further comprises a fixing plate arranged orthogonal to the supporting plate. The fixing plate is rigidly connected to the supporting plate. The fixing plate comprises a slotted link, wherein the slotted link is provided with at least two slots. Within the scope of the invention, the fixing plate is also an element that comprises a slotted link, but is not formed as a continuous plate, but rather has a recess in the inner, non-functional part. In one embodiment, the slotted link comprises three slots. The cutting machine comprises a fixing element which, depending on the position of the carriage, can be brought into a slot and holds the carriage in position by means of the fixing plate. In one embodiment, the slots in the slotted link are arranged such that the carriage is pivoted by 0° when fixed in the first slot, by 18° when it is fixed in the second slot, and by 35° when it is fixed in the third slot. This cutting machine has the advantage that it can be used very flexibly on account of the pivot capability of the carriage and the position of the carriage being secured by the fixing device. The carriage is also not slowly moved into the starting position by the weight of particularly heavy cutting material as a result of gravity, since the fixing element, which engages in one of the slots of the fixing plate, can accept this weight.

In one embodiment, the slotted link with the slots is attached to an outer edge of the fixing plate. This is advantageous in particular because the fixing element can easily be brought into the slots. In one embodiment, the slotted link is attached to the outer edge of the fixing plate, located remotely from the supporting plate.

In one embodiment, the carriage is connected to the machine housing via a carriage base. The carriage base comprises a supporting frame or a supporting plate. The term "supporting frame" or "supporting plate" refers to a component that is arranged preferably substantially orthogonal to the cutting plane and forms the end part of the carriage base or is attached to the end of the carriage base. This component extends in the plane orthogonal to the cutting plane and serves as a stop for the supporting plate, and as a mechanical connection of the supporting plate to the carriage base. In the starting position of the supporting plate, it rests on the carriage base, in particular on the supporting frame of the carriage base.

In one embodiment, the fixing element, which can engage in the slots of the slotted link and fixedly holds the fixing plate, is a lever. Depending on the carriage position, i.e., depending on the pivot position of the supporting plate, the lever can engage in one of the slots of the fixing plate. If the lever is mounted in a slot and thus fixedly holds the fixing plate, the lever can be guided out of the slot by a movement. In one embodiment, a handle is attached to the lever for these movements of the lever. In one embodiment, the lever can be pivoted in a plane parallel to the plane of the supporting frame. In one embodiment, a spring or spring element that pushes the lever into the slot of the fixing plate is located on a device that supports the lever so that it can pivot. This means that the lever is pushed by the spring onto a particular point in the plane parallel to the plane of the supporting frame. An operator can pivot the lever away from this point in this plane by counteracting the spring force. The operator moving the supporting plate of the carriage also moves the fixing plate. In the process, the positions of the slots in the slotted link are also displaced in space. If a slot is at the point onto which the lever is pushed by the spring force, the lever can be pushed into the slot by the spring force or by an operator guiding the lever into the slot. The lever thus fixes the fixing plate at this point and the position of the pivoting device, and thus the position of the supporting plate. The spring or the spring element causes the lever to remain pushed into the slot and not to slip out of the slot by itself. The position of the supporting plate is thus fixed by means of the lever until an operator pivots the lever out of the slot against the spring force. Only then can the supporting plate be pivoted.

In one embodiment, the pivoting device comprises at least one radial bearing. The axis of the radial bearing extends orthogonal to the cutting plane. The pivoting device is connected to the supporting plate in the region in which the bearing wall is connected to the supporting plate. In other words, this means that, in the cross-section of the carriage, there is a region in which the supporting plate, the bearing wall and the pivoting device coincide. This embodiment also includes a solution, wherein the pivoting device is connected to the supporting plate and the bearing wall is also connected to the supporting plate, without the pivoting device and the bearing wall directly touching each other. This embodiment also includes a solution in which the pivoting device is connected to the bearing wall and the supporting plate is also connected to the bearing wall without the pivoting device and the supporting plate directly touching each other. However, it is common to all embodiments that the contact points are located in a spatially narrow region which is formed by an edge of the supporting plate and a corresponding edge of the bearing wall.

In one embodiment, the supporting frame comprises a displacement device. The displacement device mechanically connects the pivoting device to the supporting frame. The pivoting device can be moved parallel to the plane of the supporting frame by means of the displacement device.

In one embodiment, the fixing plate comprises a slotted link guide. A pin or bolt engages in the slotted link guide. The pin or bolt is fixedly connected to the supporting frame. Pivoting of the supporting plate results in movement of the fixing plate comprising the slotted link guide. Due to the fixed pin or bolt and the slotted link guide, the fixing plate is forced into a particular trajectory relative to the supporting frame. This causes a movement of the pivoting device in the displacement device. In one embodiment, the bolt comprises a ball bearing in order to better slide in the slotted link guide. This design results in the axis of the radial bearing of the pivoting device moving in a plane parallel to the plane of the supporting frame when the supporting plate is pivoted. When the supporting plate is pivoted, the bearing wall connected orthogonal thereto is also pivoted. When the carriage is brought to the starting position remote from the blade, the bearing wall, and in particular a lateral hand guard plate attached to the bearing wall, are approximately flush with the edge of the stop plate. If the carriage were in a pivoted-up position without the displacement device, this starting position would result in a gap between the bearing wall/lateral hand guard plate and the stop plate. An operator could put his hand into this gap and injure himself if he simultaneously moves the carriage in the cutting direction in order to cut a slice off the strand-shaped food. By moving the pivoting device in the displacement device, this gap is avoided when the carriage is pivoted up. In this way, risk of injury cannot arise. Moving the pivoting device furthermore avoids the bearing wall no longer covering the cutting blade in the carriage end position. It is thus also possible, in the pivoted-up position, for a cutting material of large diameter to be cut without the stop of the carriage end position being moved further to the rear. As a result, the machine housing of a known cutting machine does not have to be re-engineered in order to realize the invention.

In one embodiment, a bushing holds a shaft. The bushing can be moved parallel to the plane of the supporting frame by means of a linear guide of the supporting frame. The shaft is oriented orthogonal to the cutting plane and is part of the pivoting device. At least one radial bearing is attached to the shaft so that it can rotate and is fixedly connected to the supporting plate. The shaft thus forms the pivot point for the pivoting movement of the supporting plate. The pivot point for the pivoting movement of the supporting plate can thus be moved parallel to the plane of the supporting frame. In one embodiment, an end of the shaft is linearly guided in a guide rail. The guide rail is part of the supporting frame. The shaft is thus linearly guided in its linear movement at two locations, the bushing and the guide rail, and is thus protected against rotations in the opposite direction of the axis of the shaft. In one embodiment, the shaft is screwed into the bushing or is rotationally secured by a crimp connection with a screw. In this embodiment, the shaft is also protected against rotations about the axis of the shaft. In one embodiment, a wheel or ball bearing is attached to the end of the shaft at the point that runs in the guide rail of the supporting frame. This facilitates movement of the shaft in the guide rail. In one embodiment, a radial bearing is located between the bushing and an end piece screwed to the shaft. The end piece has a larger diameter than the radial bearing. Axial movement of the radial bearing is prevented by the end piece on one side and by the bushing on the other side. The screw connection in the bushing prevents the shaft from moving in the axial direction in the bushing. Movement of the radial bearing on the shaft in both axial directions is thus prevented, and the supporting plate of the carriage cannot move off the shaft in a direction orthogonal to the cutting plane.

In one embodiment, the pivoting device comprises a rotation damper. If the lever is not brought into one of the slots of the fixing plate, the supporting plate is pulled downward by the force of gravity and falls into the starting position. The supporting plate then strikes the supporting frame. The rotation damper counteracts this force. In one embodiment, the rotation damper counteracts both movement directions of the pivoting movement. In one embodiment, the rotation damper counteracts only the pivoting movement carried out by the force of gravity. In one embodiment, the rotation damper pushes, by means of a spring, a torsion-proof brake element against a radial bearing fixedly connected to the supporting plate. In one embodiment, the brake element is mounted as a brake ring on the shaft and is pushed by the spring against one side of a radial bearing, and thus brakes the supporting plate. In this embodiment, the spring is also mounted on the shaft and is fixed with a stop on the side remote from the brake element. In one embodiment, the spring, with its spring force, directly counteracts the weight acting on the supporting plate. In this case, the spring force is applied to a radial bearing fixedly connected to the supporting plate.

In one embodiment, the carriage comprises a locking button engaging in a detent. The carriage can be tilted about a carriage axis by releasing the locking button.

In one embodiment, the cutting machine is a vertical cutting machine. This means that the cutting plane is a vertical plane and the supporting plate in the starting position is oriented parallel to the horizontal plane. In one embodiment, the supporting plate in the pivoted-up position is oriented at an angle of between 30° and 40°, preferably 35°, to the horizontal plane. In one embodiment, the supporting plate in a middle position is oriented at an angle of between 12° and 23°, preferably 18°, to the horizontal plane.

In one embodiment, the cutting machine is an inclined cutting machine. This means that the cutting plane is tilted relative to the vertical direction so that cut-off slices fall into a product storage area due to the force of gravity.

FIG. 1 schematically shows an exemplary embodiment of a cutting machine 1 for cutting slices of in particular strand-shaped cutting material. The cutting machine is a food cutting machine 1, comprising a machine housing 2 on which the following components are mounted: a drive motor and a cutting blade 11, driven in rotation by the former in a cutting plane, for cutting individual slices off the cutting material; and a stop plate 21, displaceable parallel to the cutting plane, for setting a desired slice thickness.

The machine housing 2 of the cutting machine 1 has a substantially rectangular base on which a motor tower projects upward. The drive motor is accommodated in this motor tower. The drive motor is connected to the cutting blade 11 via a gear mechanism and drives said cutting blade. The cutting blade 11 is designed as a circular blade. A control unit and an input/output unit for operating the cutting machine 1 are arranged on the top side of the motor tower.

The cutting blade 11 is covered by a C-shaped blade guard ring 22 in the region of the cutting edge in order to prevent inadvertent contact with the cutting edge of the cutting blade. The front side of the cutting blade 11 is secured with a flat blade cover 23. The cutting machine 1 shown is what is known as a vertical cutter, i.e., the cutting blade 11 is designed as a circular blade which rotates in a vertically oriented cutting plane. The cutting area of the cutting blade 11 is defined by the area left open by the blade guard ring 22. The stop plate 21, displaceable parallel to the cutting blade 11, is arranged in front of the cutting area. The stop plate 21 can be adjusted via a rotary knob 25 in order to set a desired slice thickness.

Arranged in the region in front of the cutting blade 11 is a carriage 3 displaceable parallel to the cutting plane, i.e., along a carriage axis. The carriage 3 has a carriage base 32 which is mounted in the machine housing 2 on a linear guide. The carriage 3 has a locking button 31 which engages through the carriage base 32 in a detent in the machine housing 2. The carriage 3 can be tilted about the carriage axis by releasing the locking button 31. The carriage further comprises a hand guard 33.

The carriage 3 also comprises a supporting plate or supporting frame 34 oriented in the horizontal direction. The supporting frame 34 forms the end of the carriage base 32. The carriage 3 further comprises a supporting plate 35 and a bearing wall 36 which are mounted orthogonal to one another. On the other side of the supporting plate 35, the carriage 3 comprises a carriage rear wall 37 which is also mounted orthogonal to the supporting plate 35. The cutting material is placed onto the supporting plate 35 and against the bearing wall 36. The supporting plate 35 is mounted so as to be able to pivot with respect to the supporting frame 34 via a pivoting device 38. A first working position for cutting food is preferably located in the starting position, in which the supporting plate 35 is oriented horizontally. A second working position, the pivoted-up position, for cutting food is preferably located in the position in which the supporting plate 35 is pivoted with respect to the supporting frame 34 between 30° and 40°, preferably 35°. A third working position, the middle position, for cutting food is preferably located in the position in which the supporting plate 35 is pivoted with respect to the supporting frame 34 in the range between 12° and 23°, preferably 18°.

The supporting plate 35 is fixedly connected to a fixing plate 39. The fixing plate 39 is attached orthogonal to the supporting plate 35. The fixing plate 39 has, on the lower side remote from the supporting plate 35, a slotted link comprising three slots 40, 41, 42. The slots 40, 41, 42 are designed such that a lever 43 which can pivot in a plane parallel to the supporting plate 35 can engage in a slot 40, 41, 42. The lever 43 serves as a fixing element of the supporting plate 35 and, when it engages in one of the slots 40, 41, 42, fixedly holds the supporting plate 35. In which slot 40, 41, 42 the lever 43 can engage depends on the position of the fixing plate 39 and thus on the pivot position of the supporting plate 35. The lever 43 can engage in the slot 40, 41, 42 that is located in the plane in which the lever 43 can be pivoted. In the starting position of the supporting plate, a first slot 40 of the fixing plate 39 lies in the pivot plane of the lever 43. Thus, when inserted into the first slot 40, the lever can fix the supporting plate 35 in the starting position. In a middle position of the supporting plate 35, a second slot 41 of the fixing plate 39 lies in the pivot plane of the lever 43. Thus, when inserted into the second slot 41, the lever 43 can fix the supporting plate 35 in the middle position. In a pivoted-up position of the supporting plate 35, a third slot 42 of the fixing plate 39 lies in the pivot plane of the lever 43. Thus, when inserted into the third slot 42, the lever 43 can fix the supporting plate 35 in the middle position. By moving, i.e., by pivoting the lever 43, it can be guided out of a slot 40, 41, 42 of the fixing plate 39, and pivoting movement of the supporting plate 35 is thus made possible.

Figure 2:
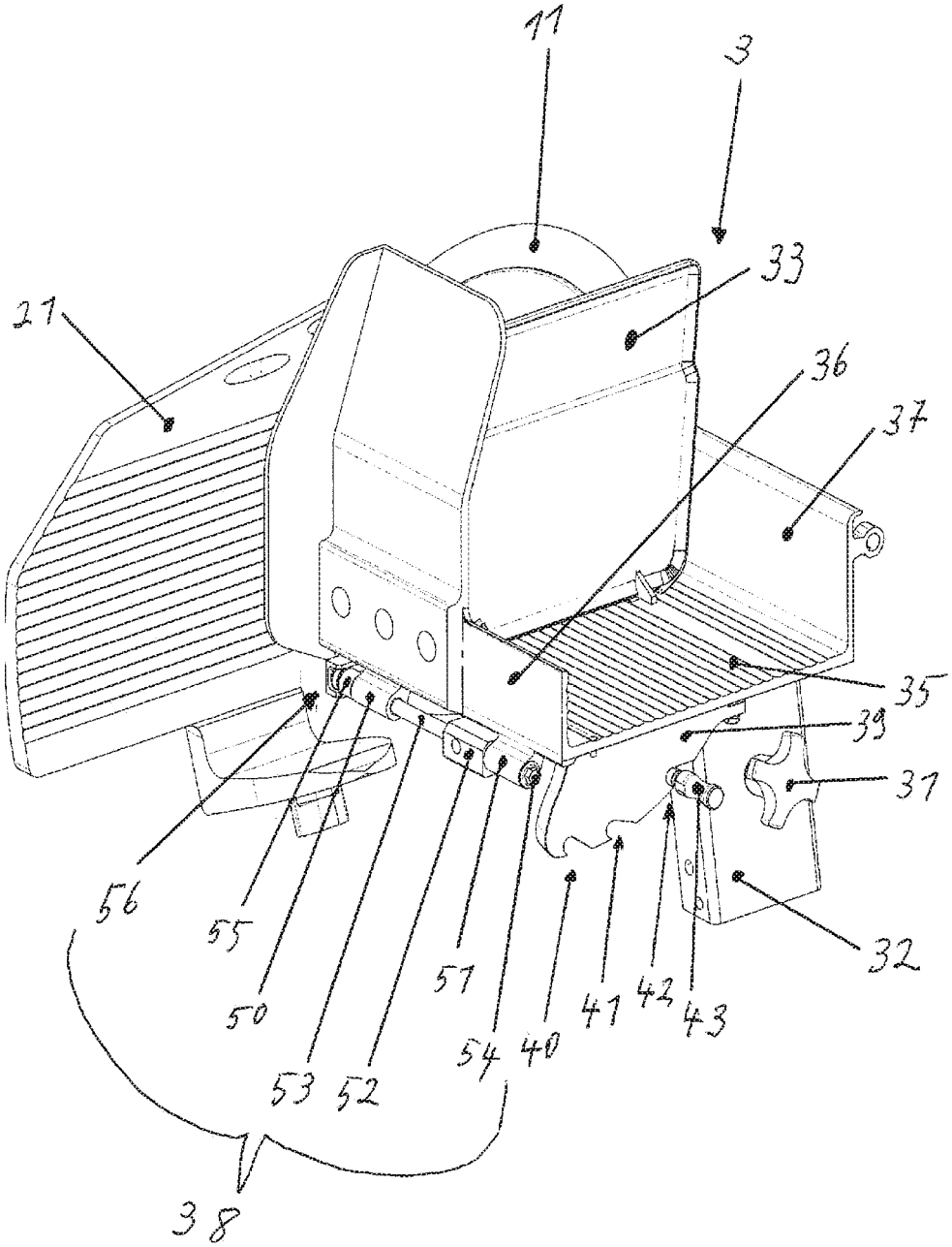
FIG. 2 shows a carriage of a cutting machine according to the invention.

FIG. 2 shows a further view of a carriage 3 which is already described in connection with FIG. 1 and in which the supporting plate 35 is arranged in the starting position. FIG. 2 shows the pivoting device 38 which comprises a first radial bearing 51, a second radial bearing 50, a bushing 52, a shaft 53, an end piece 54, and a rotation damper 55. A guide rail 56 is shown which is a component of the supporting frame 34 and guides the shaft 53 in its movement parallel to the plane of the supporting frame 34. The mode of operation of the pivoting device 38 is described in more detail in connection with FIG. 8.

Figure 3:
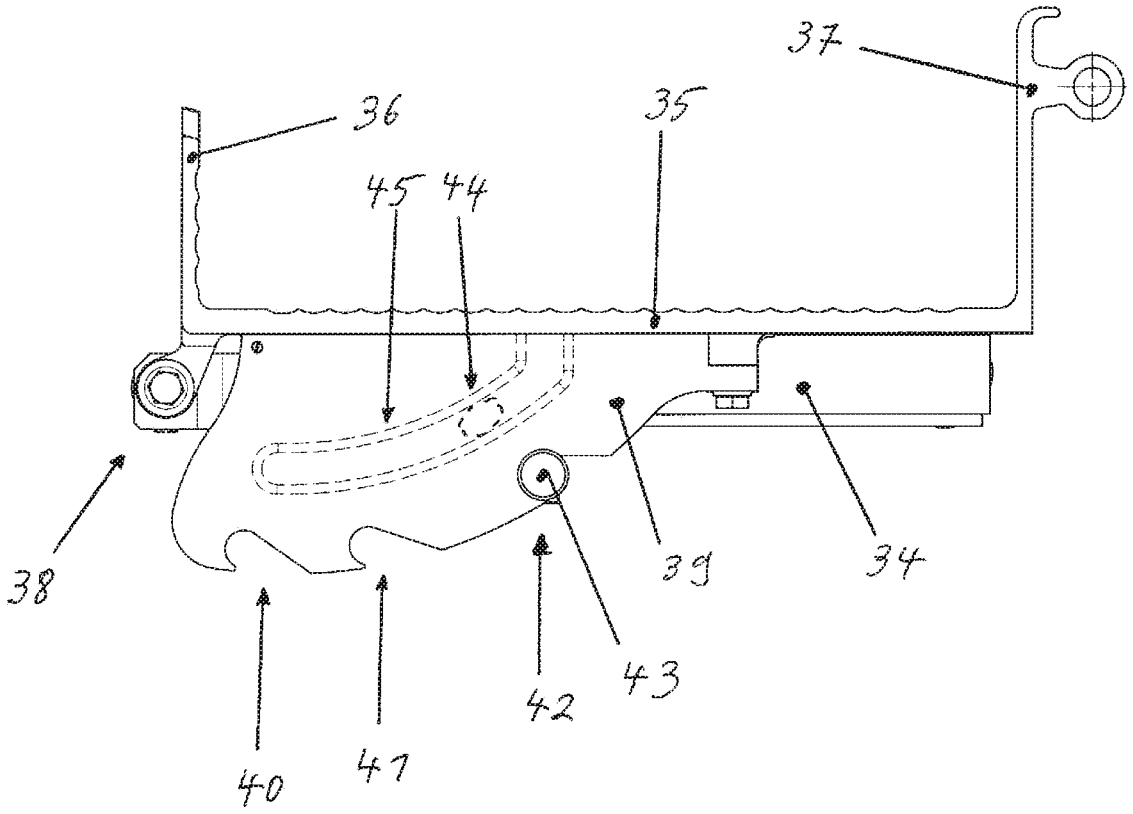
FIG. 3 shows a carriage of a [cutting machine] according to the invention in a starting position.

FIG. 3 shows the carriage 3 when the supporting plate 35 is in the starting position. That means that the supporting plate 35 is oriented parallel to the supporting frame 34. The lever 43 is located in the third slot 42 of the fixing plate 39. This prevents the supporting plate 35 from being pivoted. The slotted link guide 45 in this view is located on the rear side of the fixing plate 39 but is indicated by dashed lines to illustrate the mechanism. The same applies to the bolt 44, which determines the position of the fixing plate 39 by means of the slotted link guide 45.

Figure 4:
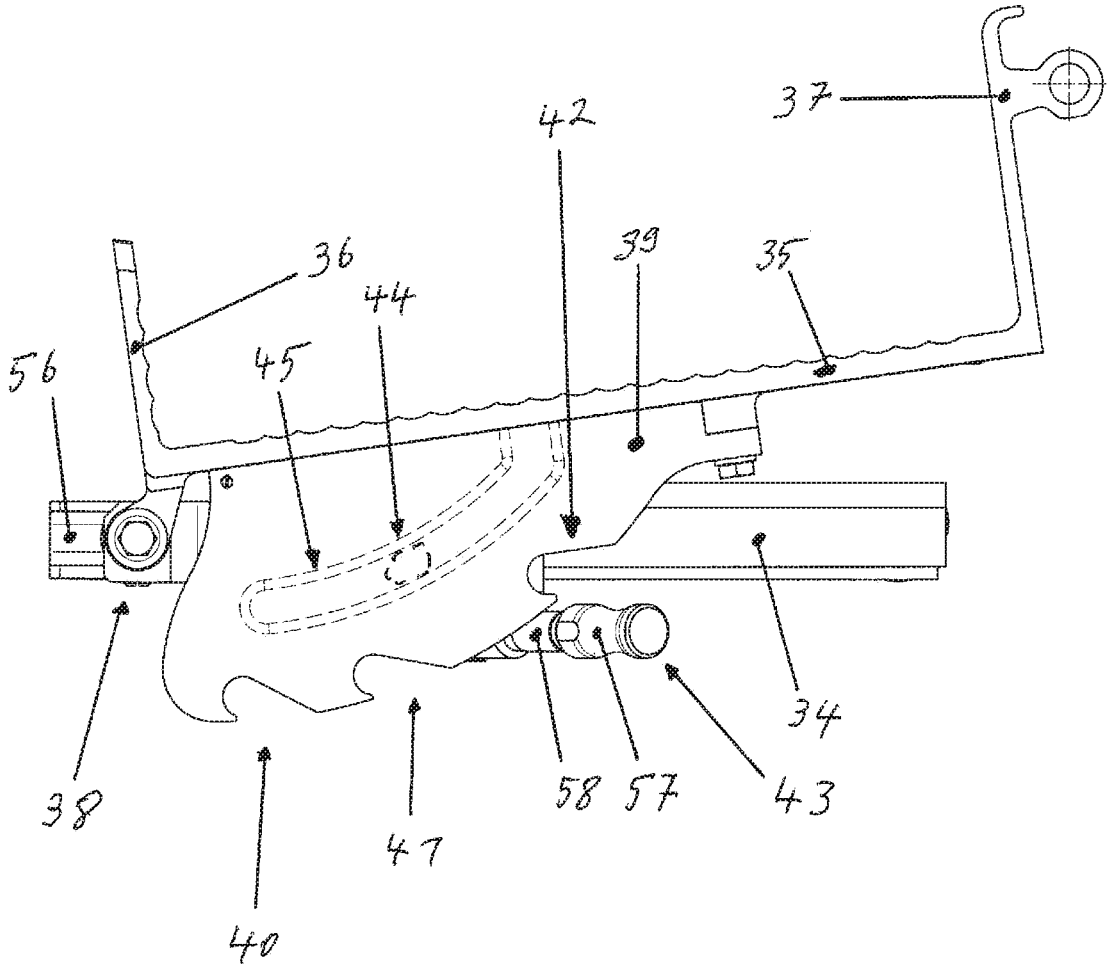
FIG. 4 shows a carriage of a cutting machine according to the invention during pivoting of the supporting plate.

FIG. 4 shows the carriage 3 at a point in time during pivoting from the starting position to the middle or pivoted-up position. In order to unlock the fixing plate 39, the lever 43 has been pivoted in its pivot plane, i.e., in a plane parallel to the plane of the supporting frame 34. It is still in this position and therefore has no direct contact points with the fixing plate 39. For this reason, the supporting plate 35 (including the bearing wall 36 and the carriage rear wall 37) can be pivoted by means of the pivoting device 38. This is carried out by an operator manually moving the supporting plate 35 correspondingly, e.g., by grasping the carriage rear wall 37 and pulling it upward, for example. This unlocked illustration shows that the lever 43 described in detail in FIG. 7 comprises a handle 57 and a locking surface 58.

The slotted link guide 45, indicated by dashed lines on the rear side of the fixing plate 39, in operative connection with the bolt 44, which is rigidly mounted on the supporting frame 34, results in the pivot point of the supporting plate 35, i.e., the pivoting device 38, being moved to the right in the drawing by means of a linear guide when the supporting plate 35 is pivoted up. In this position, a guide rail 56 can be seen which is mounted in the supporting frame 34 and serves to guide the pivoting device 38 during this movement.

Figure 5:
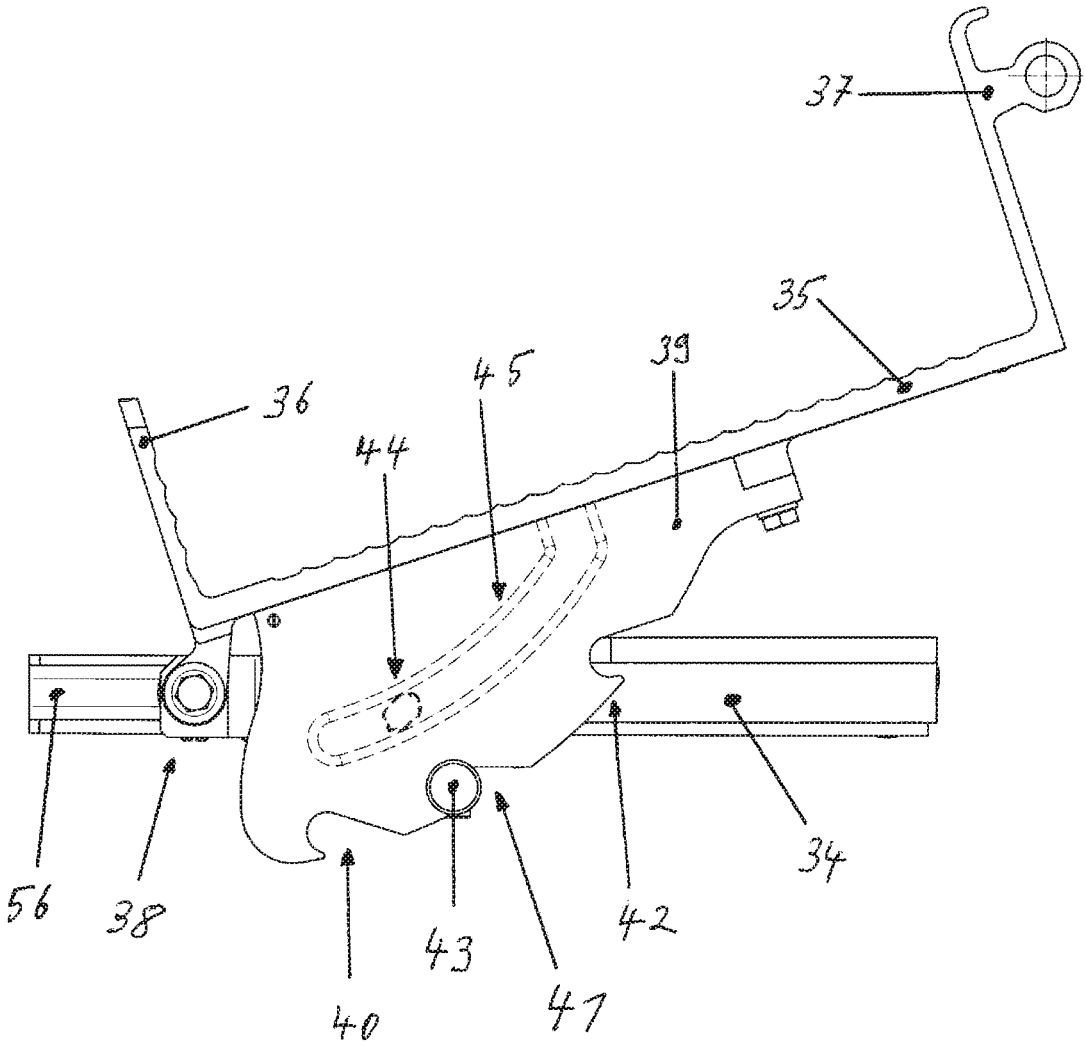
FIG. 5 shows a carriage of the cutting machine according to the invention in a middle pivot position.

FIG. 5 shows the carriage 3, the supporting plate 35 of which is pivoted into the middle position and is held in this position by means of the lever 43 and the second slot 41 of the fixing plate 39. The linear displacement of the pivoting device 38 in the plane parallel to the plane of the supporting frame 34 is shown. It can also be seen that the bolt 44, connected to the supporting frame 34, is located elsewhere in the slotted link guide 45 on the rear side of the fixing plate 39. More of the guide rail 56 mounted in the supporting frame 34 can be seen in this position, since the pivoting device 38 has moved further in the guide rail 56 in comparison to FIG. 4.

Figure 6:
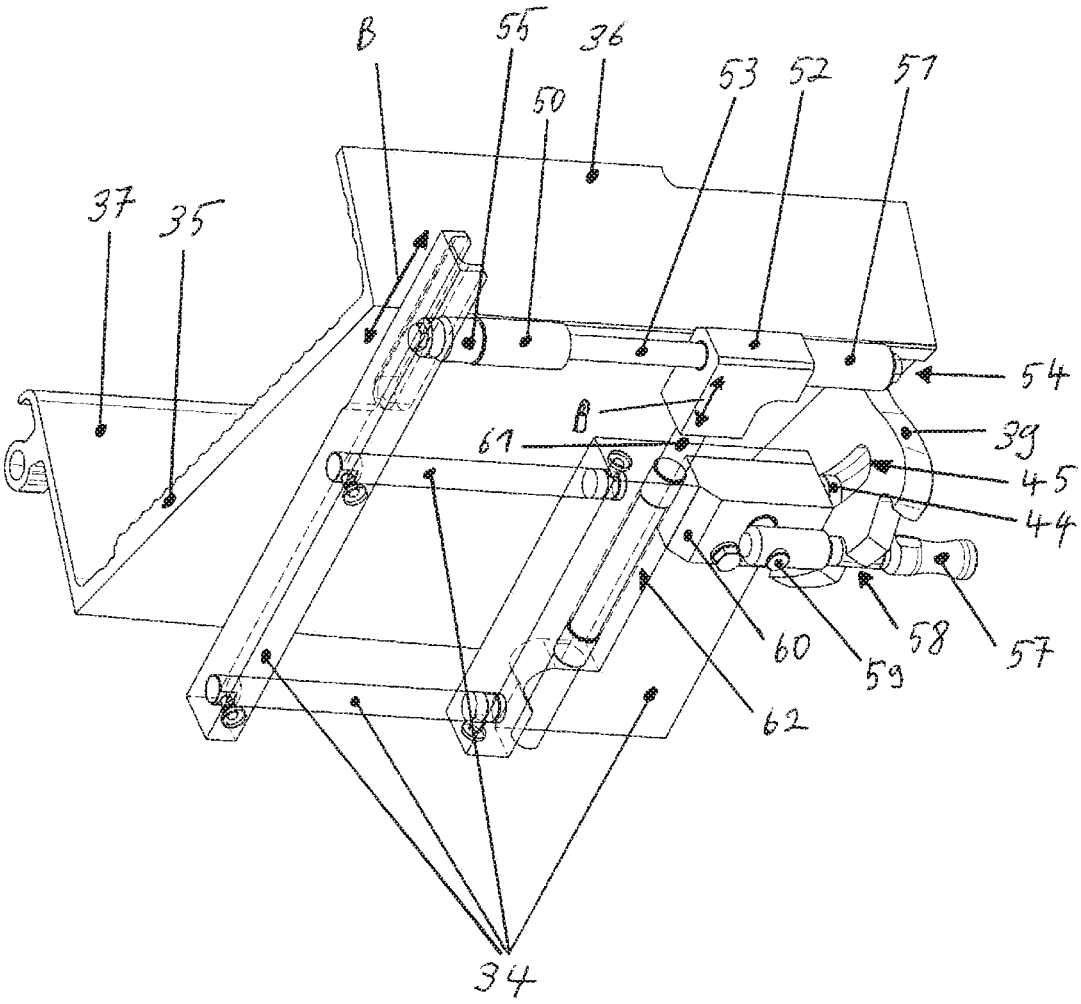
FIG. 6 shows a carriage of the cutting machine according to the invention in a view from below.

FIG. 6 shows the carriage in a view from below. The design of the supporting frame 34 is shown. The supporting frame 34 comprises a displacement device 61, 62 by means of which the pivoting device 38 can be displaced along a displacement direction B in a plane parallel to the plane of the supporting frame. The displacement device 61, 62 consists of a cylindrical bushing 62, extending in the supporting frame 34 along displacement direction B, and a rod 61, sliding in the cylindrical bushing 62. The rod 61 holds the bushing 52 of the pivoting device 38 so that said bushing 52 can be linearly displaced, wherein the bushing 52 in turn holds the shaft 53 of the pivoting device 38. The supporting frame 34 holds a lever housing 60 of the lever 43, which serves to fix the fixing plate 39 by means of its slots 40, 41, 42. The lever 43 comprises a handle 57 by means of which the operator can move the lever, and a locking surface 58 which engages in the slots 40, 41, 42 of the fixing plate 39. The lever 43 is mounted so as to be rotatable in a plane parallel to the plane of the supporting frame 34 via a lever shaft 59 in the lever housing 60. FIG. 6 shows the slotted link guide 45 mounted on or in the inner side of the fixing plate 39. The bolt 44 is rigidly and thus fixedly connected to the supporting frame 34 and only allows one mechanically defined movement of the fixing plate 39. During pivoting of the supporting plate 35 by means of the pivoting device 38, the bushing 52 of the pivoting device 38, which holds the shaft 53 and thus defines the axial position of the pivoting device 38, is forced to move along displacement direction B by means of the displacement device 61, 62, consisting of cylindrical bushing 62 and rod 61. The shaft 53 is held in a defined direction in the bushing 52 of the pivoting device 38, by means of which the end of the shaft 53 likewise moves in the guide rail 56 along displacement direction B.

Figure 7:
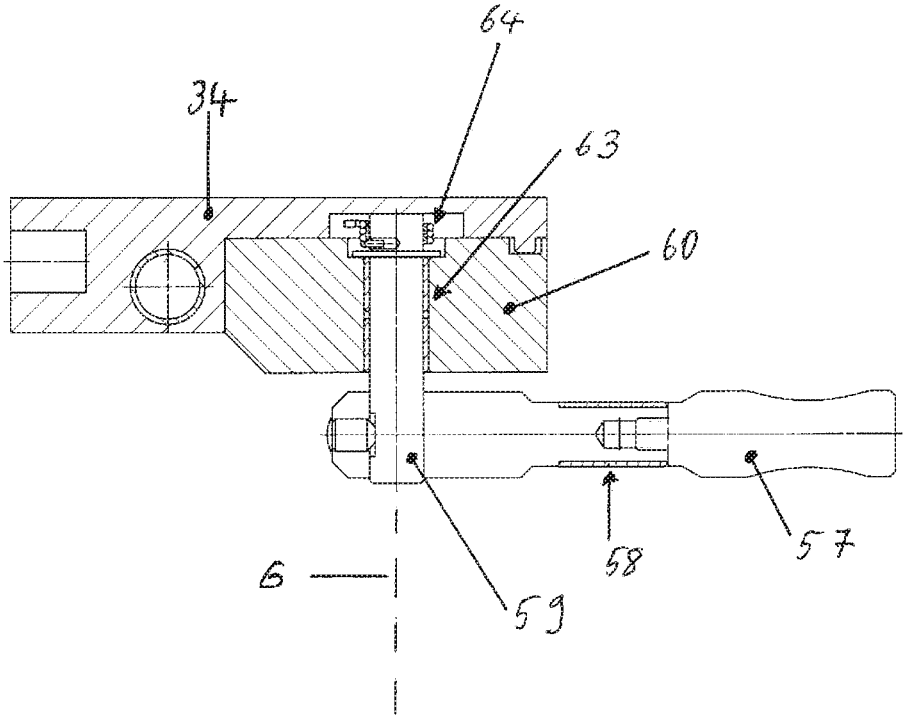
FIG. 7 shows a fixing element of the cutting machine according to the invention.

FIG. 7 shows the lever 43 in section. The lever housing 60 is mounted on the supporting frame 34. The lever shaft 59 is mounted so as to be rotatable in a bearing 63 in the lever housing 60. The lever shaft rotates about the axis G of the bearing. A spring 64 generates a restoring force, which pushes the lever 43 into a rest position. The rest position of lever 43 is the position in which the lever engages in one of the slots 40, 41, 42 of the fixing plate 39. If an operator wishes to release the fixing plate 39, he pivots lever 43 out of the slot 40, 41, 42 against the restoring force and can thus pivot the supporting plate 35. If lever 43 is in a slot 40, 41, 42 of the fixing plate 39, the spring 64 and the restoring force exerted by it thus prevents the lever from slipping out of the slot 40, 41, 42. The movement of lever 43 in the direction of the restoring force is limited by a stop, which at the same time constitutes the rest position of lever 43.

Figure 8:
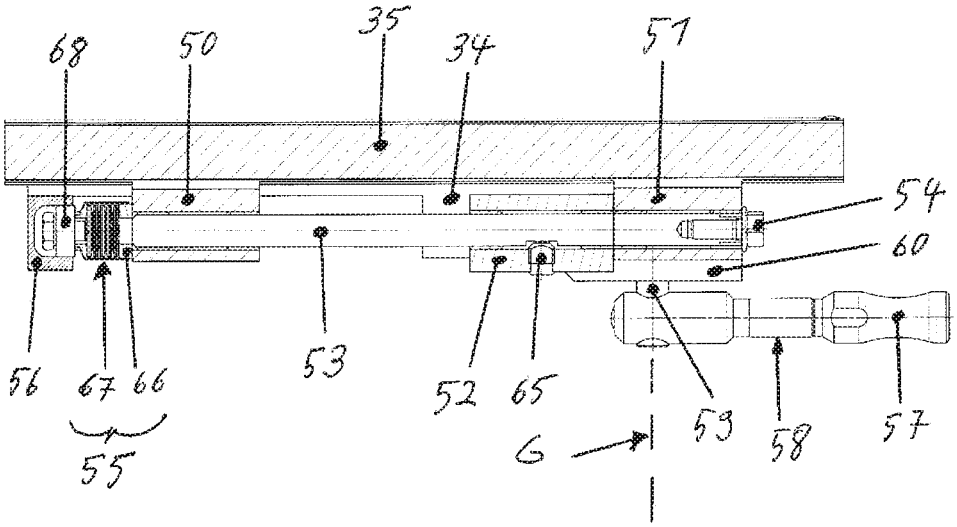
FIG. 8 shows a pivoting device of the cutting machine according to the invention in an axial section.

FIG. 8 shows a section through the pivoting device 38. In order to fixedly hold the shaft 53 in the axial direction, it is secured in the bushing 52 by a screw 65. The screw may be screwed directly into the shaft 53 or engage in a notch of the shaft 53. The shaft 53 need not be mounted in the bushing 52. The first radial bearing 51, which is rigidly connected to the supporting plate 35, is fixed in the axial direction between the bushing 52 and an end piece 54. The axial position of the second radial bearing 50 on the shaft 53 is rigidly defined since the second radial bearing 50 is also rigidly connected to the supporting plate 35. A rotation damper 55 brakes the second radial bearing 50 during a pivoting movement of the supporting plate 35. A torsion-proof brake element 66 of the rotation damper 55 is pushed by means of a spring 67 against a lateral surface of the second radial bearing 50 in order to achieve the damping effect. At its end opposite the end piece, the shaft 53 is guided by the guide rail 56 of the supporting frame 34. A roller or ball bearing 68 facilitates movement of the end of the shaft 53 in the guide rail 56.

Figure 9:
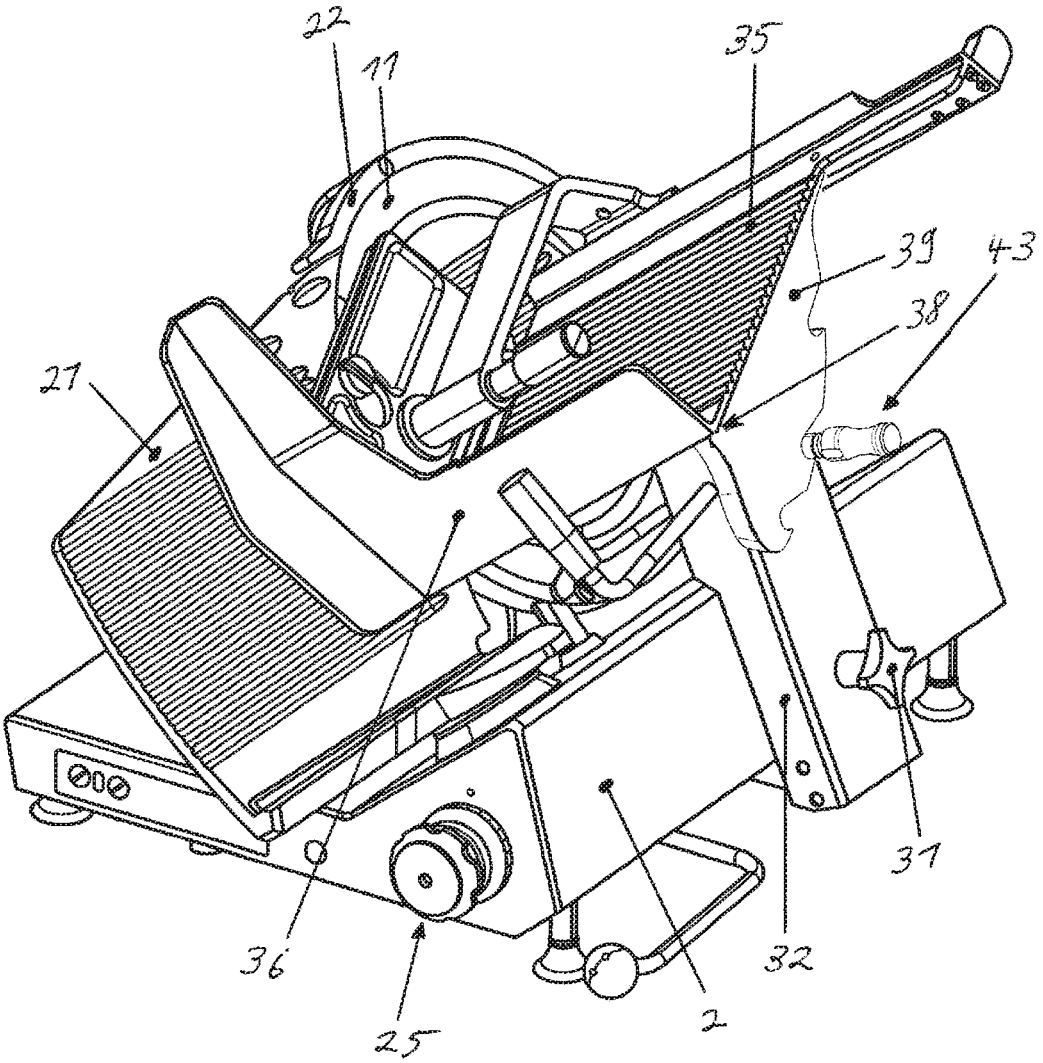
FIG. 9 shows a cutting machine according to the invention, designed as an inclined cutting machine.

FIG. 9 shows a cutting machine according to the invention designed as an inclined cutter. In an inclined cutter, the cutting plane formed by the blade 11 is tilted with respect to the vertical direction. The inclined cutter also comprises a stop plate 21, a machine housing 2, blade guard ring 22, a carriage base 32, a locking button 31, a supporting plate 35, and a bearing wall 36, reference being made to FIG. 1 regarding their description. A fixing plate 39 is mounted orthogonal to the supporting plate 35. A lever 43 for fixing the fixing plate 39 is pivotable in a plane parallel to the supporting frame, with the supporting frame resting on the carriage base 32. Regarding the function, reference is made mutatis mutandis to the preceding description.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A cutting machine for cutting slices of in particular strand-shaped cutting material, comprising:

a machine housing;

a drive motor;

a cutting blade, driven in rotation by the drive motor in a cutting plane, configured to cut off slices;

a stop plate, displaceable parallel to the cutting plane, configured to set a desired slice thickness;

a carriage, movable back and forth parallel to the cutting plane, having a supporting plate and a bearing wall, the supporting plate and the bearing wall forming a holding device for the cutting material, the carriage comprising a pivoting device configured to move the supporting plate between a starting position and a pivoted-up position, the supporting plate in the starting position and in the pivoted-up position forming a right angle with the cutting plane; and a fixing plate arranged orthogonal to the supporting plate and being rigidly connected to the supporting plate, the fixing plate comprising a slotted link, the slotted link comprising at least two slots for a fixing element.

2. The cutting machine according to claim 1, wherein the slotted link is attached to an outer edge of the fixing plate.

3. The cutting machine according to claim 1, wherein the carriage is connected via a carriage base to the machine housing, wherein the carriage base comprises a supporting frame, and wherein in the starting position, the supporting plate rests on the carriage base.

4. The cutting machine according to claim 3, wherein the supporting frame comprises a displacement device which mechanically connects the pivoting device to the supporting frame, and wherein the pivoting device is movable parallel to the plane of the supporting frame by the displacement device.

5. The cutting machine according to claim 4, wherein the fixing plate comprises a slotted link guide in which a bolt engages, wherein the bolt is fixedly connected to the supporting frame, and wherein pivoting of the supporting plate mechanically causes movement of the pivoting device in the displacement device vis-à-vis the slotted link guide.

6. The cutting machine according to claim 4, further comprising a bushing movable parallel to the plane of the supporting frame vis-à-vis a linear guide of the supporting frame, wherein the bushing holds a shaft, wherein the at least one radial bearing is mounted so as to be rotatable on the shaft and is fixedly connected to the supporting plate, and wherein one end of the shaft is linearly guided in a guide rail of the supporting frame.

7. The cutting machine according to claim 3, wherein in the starting position, the supporting plate rests on the supporting frame of the carriage base.

8. The cutting machine according claim 1, wherein the fixing element comprises a lever configured to engage in one of the slots of the fixing plate depending on the carriage position, or to be guided out of this slot, and wherein the lever is movable.

9. The cutting machine according to claim 8, wherein the lever is pushable by a spring into a slot of the fixing plate.

10. The cutting machine according to claim 8, wherein the lever is pivotable.

11. The cutting machine according to claim 8, wherein the lever is movable in a plane parallel to the plane of the supporting frame.

12. The cutting machine according to claim 8, wherein the lever is pivotable in a plane parallel to the plane of the supporting frame.

13. The cutting machine according to claim 1, wherein the pivoting device comprises at least one radial bearing, an axis of which extends orthogonal to the cutting plane, and wherein the pivoting device is connected to the supporting plate in a region in which the bearing wall is connected to the supporting plate.

14. The cutting machine according to claim 1, wherein the pivoting device comprises a rotation damper.

15. The cutting machine according to claim 14, wherein the rotation damper is configured to push a torsion-proof brake element against a radial bearing vis-à-vis a spring, and wherein the radial bearing is fixedly connected to the supporting plate.

16. The cutting machine according to claim 1, wherein the carriage comprises a locking button which engages in a detent, and wherein the carriage is tiltable about a carriage axis by releasing the locking button.

17. The cutting machine according to claim 1, wherein the cutting machine comprises a vertical cutting machine, and wherein the supporting plate is oriented parallel to a horizontal plane in the starting position.

18. The cutting machine according to claim 17, wherein, in the pivoted-up position, the supporting plate is oriented at an angle between 30° and 40° to the horizontal plane.

19. The cutting machine according to claim 1, wherein the cutting machine comprises an inclined cutting machine.

20. The cutting machine according to claim 1, wherein the at least two slots comprise three slots.

* * * * *